US008333170B2

(12) United States Patent
Zaman

(10) Patent No.: US 8,333,170 B2
(45) Date of Patent: Dec. 18, 2012

(54) BUCKSTAY SYSTEM

(75) Inventor: Dewan Shamsuz Zaman, Surrey (GB)

(73) Assignee: Doozan Babcock Energy America, LLC, Atlanta, GA (US)

( * ) Notice: Subject to any disclaimer, the term of this patent is extended or adjusted under 35 U.S.C. 154(b) by 1000 days.

(21) Appl. No.: 12/342,658

(22) Filed: Dec. 23, 2008

(65) Prior Publication Data

US 2010/0154726 A1 Jun. 24, 2010

(51) Int. Cl.
*G21C 13/024* (2006.01)

(52) U.S. Cl. ..... 122/512; 122/511; 376/461

(58) Field of Classification Search ..... 122/510, 122/511, 512; 376/461, 462
See application file for complete search history.

(56) References Cited

U.S. PATENT DOCUMENTS

| | | | | | |
|---|---|---|---|---|---|
| 3,274,977 | A | * | 9/1966 | Rickard et al. | 122/240.1 |
| 4,381,735 | A | * | 5/1983 | Brunner | 122/510 |
| 5,207,184 | A | * | 5/1993 | Kreider | 122/510 |
| 5,278,880 | A | * | 1/1994 | Baker et al. | 376/285 |
| 5,557,901 | A | * | 9/1996 | Hoosic et al. | 52/506.03 |
| 5,865,149 | A | * | 2/1999 | Patel | 122/510 |
| 6,058,893 | A | * | 5/2000 | Patel | 122/510 |

* cited by examiner

*Primary Examiner* — Gregory A Wilson

(57) ABSTRACT

A buckstay system is described comprising horizontal buckstays for the walls of a steam generator, for example in plural vertically space assemblies tied with vertical buckstays, in which a buckstay extends generally horizontally across each wall such as to form a connected pair with an adjacent buckstay at each corner; an elongate tie bar formation extends across each wall such as to form a fixedly mounted pair with an adjacent tie bar formation at each corner; an anchor assembly associated with each buckstay and providing engagement means by which each buckstay engages with a respective tie bar; and each horizontal buckstay is split to comprise at least two rigid elongate buckstay elements mounted together to be relatively slideable in a buckstay longitudinal direction.

21 Claims, 6 Drawing Sheets

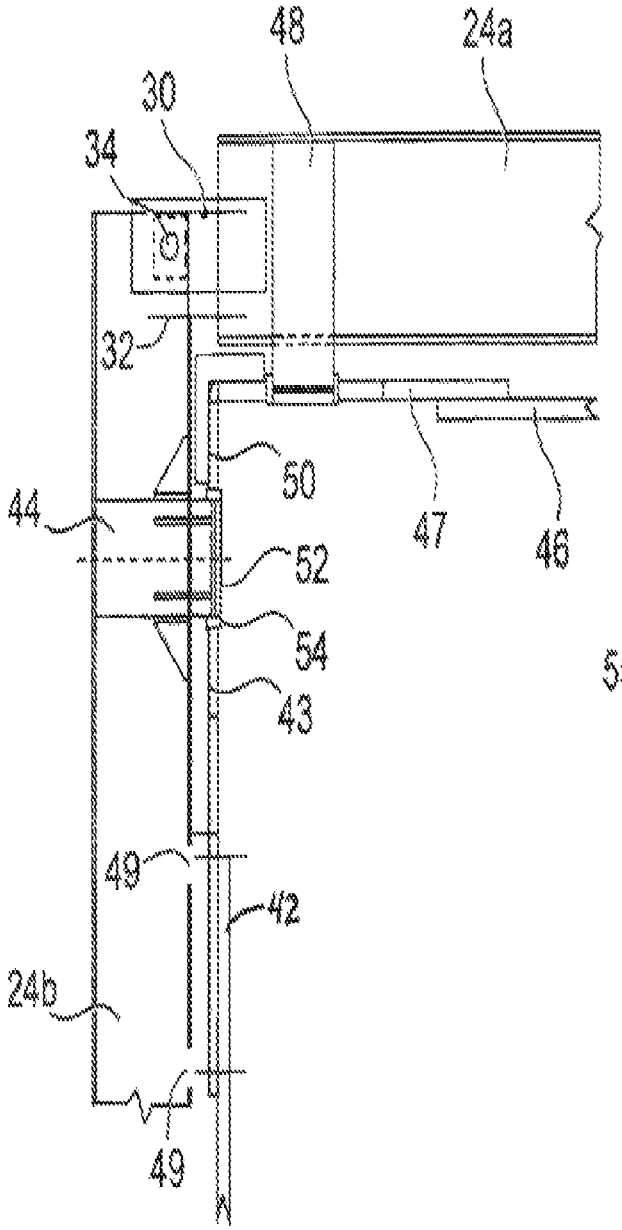
Fig. 4a
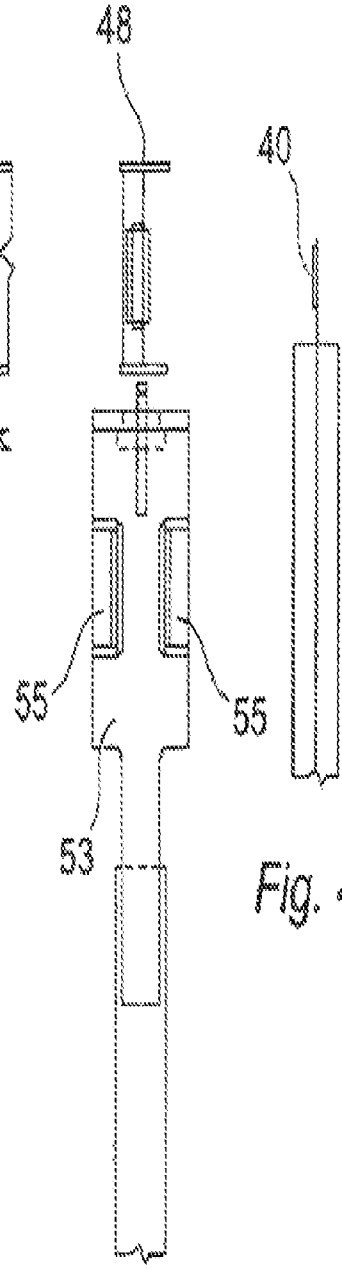
Fig. 4b
Fig. 4c (VIEW B-B)

BUCKSTAY SYSTEM

CROSS-REFERENCE TO RELATED PATENT APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

BACKGROUND OF THE INVENTION

1. Field of the Invention

The invention relates to buckstay systems for steam generation apparatus, for example for use with large boilers that are supported by a frame.

2. Description of Related Art

Boilers are commonly constructed of tube banks forming side walls, and typically planar side walls defining a structure of polygonal and usually rectangular section. As the system reaches operating temperature, the walls expand vertically and horizontally. Additionally, furnace pressure variations, pressure differential between fireside and ambient, may produce additional flexing of the tube walls either inwardly or outwardly.

To accommodate gas pressure differential and like effects the boiler walls are typically supported on the outside by an arrangement of members that surround the boiler to provide additional support to the boiler wall and limit the deformation of the wall in a horizontal direction attributable to pressure variations. The arrangement typically uses both vertical and horizontal members that are respectively known as vertical and horizontal buckstays.

Typically, horizontal buckstays are disposed in bands around the perimeter of the boiler walls at vertically spaced intervals. Horizontal buckstays surrounding the boiler at a given level walls are mechanically tied. Thus as the boiler flexes in a horizontal direction the reaction of one buckstay is resisted by the reactions of the buckstay on the opposing wall. Vertical buckstays are provided to connect series of adjacent horizontal buckstays and complete a buckstay support structure. These may be adapted at least at some points with a connection that permits a sliding action to allow relative movement between the wall and the buckstays. As the boiler expands in a vertical direction this accommodates a variable effect on the various levels of buckstays.

The typical boiler has planar walls meeting to form corners. There is a requirement to effect a connection between horizontal buckstay members where a first wall meets a second wall at an angle to form a corner. Conventionally, horizontal buckstays are continuous elongate structural members such as I-beams spanning the length of an associated wall with buckstays associated with adjacent walls extending at the corner formed by the adjacent walls to be connected by means of corner assemblies. The corner assemblies require potentially complex arrangements of links and brackets to accommodate differential expansion between a "hot" boiler wall and "cold" buckstays. An example of such a corner assembly can be seen in FIGS. 1 and 2.

SUMMARY OF THE INVENTION

According to the invention in a first aspect there is provided: a buckstay system for a wall of a steam generator having a first wall section which meets a second wall section at an angle to form a corner, the system comprising:

- a buckstay extending generally horizontally across each wall section such as to form a connected pair at the said corner;
- an elongate tie bar formation extending across each wall section such as to form a fixedly mounted pair at the corner; for example by means of an end connection corner angle reinforcement tie welded at the corner to the pair of tie bars;
- an anchor assembly associated with each buckstay and providing engagement means by which each buckstay engages with a respective tie bar;
- wherein each such buckstay is split to comprise at least two rigid elongate buckstay elements mounted together to be relatively slideable in a buckstay longitudinal direction.

A pair of buckstays in accordance with the invention as most broadly stated are associated together at a corner corresponding to a point where a first boiler wall meets a second boiler wall at an angle to form a corner, the associated buckstays being dimensioned and configured for an associated boiler to support such boiler walls in familiar manner. Each buckstay extends across an associated boiler wall. Tie bars are provided in generally conventional manner, and each buckstay engages with a respective tie bar in familiar force transferring manner so that a buckstay forming part of a buckstay assembly can react to horizontal loading in the wall and tend to prevent dishing.

However, a buckstay in accordance with the invention is particularly characterised in that it is split to comprise at least two rigid elongate buckstay elements which are slideably mounted together in mechanical association in a longitudinal direction. This slideable configuration enables each buckstay, in itself, to accommodate expansion in a longitudinal (that is, in use, horizontal) direction, and in particular to accommodate differential expansion between conditions imposed by the difference between a hot boiler wall and cold buckstays. Since the buckstay itself, by being variable in length via such a mechanical means, accommodates this expansion, the requirement in the prior art to provide potentially complex arrangements of links and brackets between a pair of buckstays at each corner is reduced or eliminated.

Instead of such a complex connection, a simple connection may be provided between the horizontal extensions of each buckstay at a corner, for example in the form of a simple mechanical connection between respective formations on each buckstay which extend beyond a said corner. For example, a fixed mechanical engagement between a bracket portion on an end of a first such buckstay and a receiving portion on an end of a second such buckstay may be provided. This joint need not provide for any expansion in a buckstay longitudinal, or horizontal, direction. Optionally, the joint may be adapted to provide for a relative variation in angle between the two buckstays meeting at the joint. Alternatively, the joint may simply be fixed, for example bolted or welded.

An anchor assembly is associated with each buckstay to enable the buckstay to engage with a tie bar of its associated wall and thus enable the buckstay arrangement in use to transmit bending forces which tend to bend each wall section to each respective buckstay, which therefore resists such bending forces in generally conventional manner.

An anchor assembly for example comprises a support formation such as a plate formation fixedly engaged with, and for example welded to, a buckstay element, and a bearing surface located to bear upon and engage in use with a surface of a tie bar. A buckstay element may comprise an anchor housing, for example including a co-operably shaped recess, to receive a support formation. In a particular preferred embodiment, two rectangular support plates, comprising an upper and a lower support plate, are deployed above and below a buckstay element to comprise an anchor assembly. The support formation(s) of the anchor assembly preferably comprise additional stiffening plates, for example in a direction parallel to and/or perpendicular to a longitudinal direction of the buckstay.

To minimise loading balances, it is preferable that each anchor assembly is provided on a buckstay element closely towards a corner formed by its associated wall and the adjacent wall. For example, each buckstay anchor assembly is preferably within 2 m and more preferably within 600 mm of such a corner.

In a more complete aspect, a buckstay system is provided for a wall of a steam generator having plural wall sections which meet adjacent wall sections at an angle to form a polygonal steam generator structure, and in particular at orthogonal angles to form a rectangular-sectioned steam generator structure. The system comprises at least one buckstay assembly comprising a plurality of buckstays as above described disposed surroundingly around the plural wall sections, the assembly thereby surrounding the perimeter of the wall of the steam generator, the buckstays configured and connected in the manner above described. That is, each buckstay in the assembly comprises at least two rigid elongate buckstay elements mounted together to be relatively slideable in a buckstay longitudinal direction.

Preferably each buckstay assembly is disposed generally horizontally. Preferably a plurality of such horizontal buckstay assemblies spaced vertically up a steam generator structure are provided.

Vertical support means may be provided to support and space such plural horizontal buckstay assemblies vertically up the steam generator, for example in the form of vertical buckstays in familiar manner. Vertical buckstays may engage with horizontal buckstays by means of engagement which is fixed in a vertical direction, or which permits movement in a vertical direction for example in sliding manner. Such buckstay arrangements will be familiar.

The distinctive feature of the present invention is in the split horizontal buckstay, providing two or more buckstay elements to comprise the horizontal buckstay, with horizontal sliding engagement provided between the elements to accommodate expansion by giving the buckstay an inherent capacity to vary in length. Conveniently, vertical supports such as vertical buckstays are provided in the vicinity of some or all of the points where buckstay elements of a horizontal buckstay make sliding engagement. For example, at a sliding engagement point between two horizontal buckstay elements, a vertical support is provided having a fixed engagement with one said element, and having a sliding engagement with the other said element whereby said element may slide horizontally relative to the vertical support and therefore relative to the other element.

In the preferred embodiment, a buckstay system comprises horizontal and vertical buckstays which can embody generally familiar principles of design. The buckstay system may be restrained and the weight carried by a support frame, for example in that load carrying restraints are provided between a buckstay and a frame member at a number of horizontal restraint levels. The buckstay system is distinctly characterised in that the horizontal buckstays are split into at least two buckstay elements to accommodate horizontal expansion, most preferably by the vertical buckstays. This dispenses with the need for complex corner bracket arrangements between adjacent horizontal buckstays at a wall corner, and can also confer advantages of flexibility of design, for example in reducing the number of buckstay fixed levels which might be required compared with typical prior art structures.

A horizontal buckstay element conveniently comprises a rigid elongate structural member, for example of a suitable structural metal such as structural steel. A buckstay conveniently comprises a rolled member. A buckstay element is for example a rolled steel member. A horizontal buckstay element may for example have a web shaped surface.

A sliding engagement between two buckstay elements is made in any suitable manner that permits sliding to vary length in a buckstay elongate direction but tends to maintain the rigidity of the structure of the buckstay to resist bending forces out of this buckstay elongate direction. For example, buckstay elements may be provided with end formations which engage in side to side sliding manner, in telescoping manner etc. For example, a sliding connection between buckstay elements may be contained within a housing to maintain rigidity of the structure out of the buckstay elongate direction. In a preferred embodiment, a buckstay element is a web structure, and a sliding engagement connection is provided which permits sliding movement in a longitudinal direction of the two buckstay elements by means of relative sliding of the web surfaces.

BRIEF DESCRIPTION OF THE DRAWING

The invention will now be described by way of example only with reference to FIGS. 1 to 7 with the accompanied drawings, in which:

FIG. 4 is a transverse section through and elevation of the buckstay corner region of FIG. 3;

DETAILED DESCRIPTION OF THE INVENTION

Figure 1:
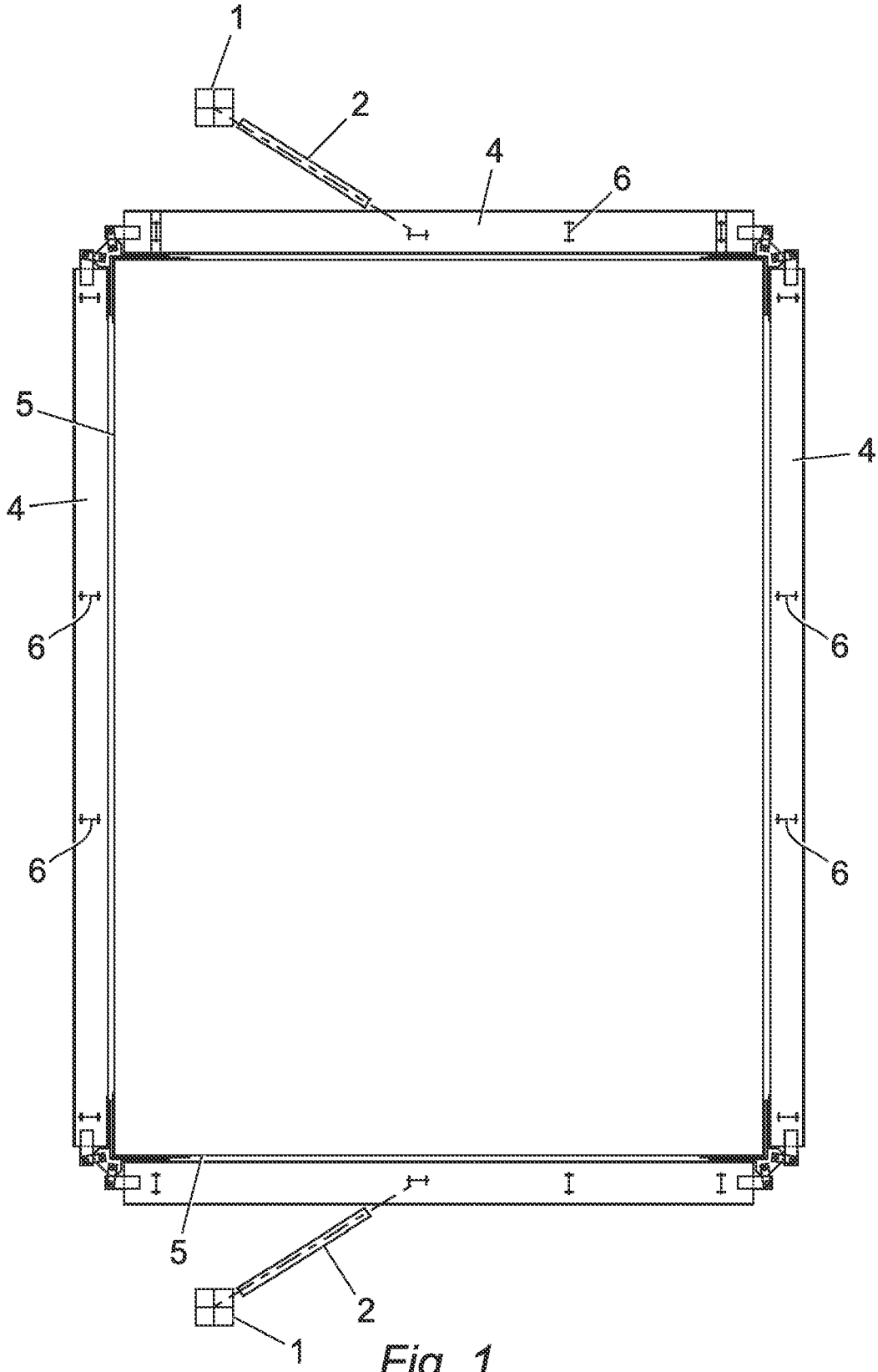
Fig. 1 (PRIOR ART)
FIG. 1 is a plan section of a prior art horizontal buckstay assembly at a restraint level.
Figure 2:
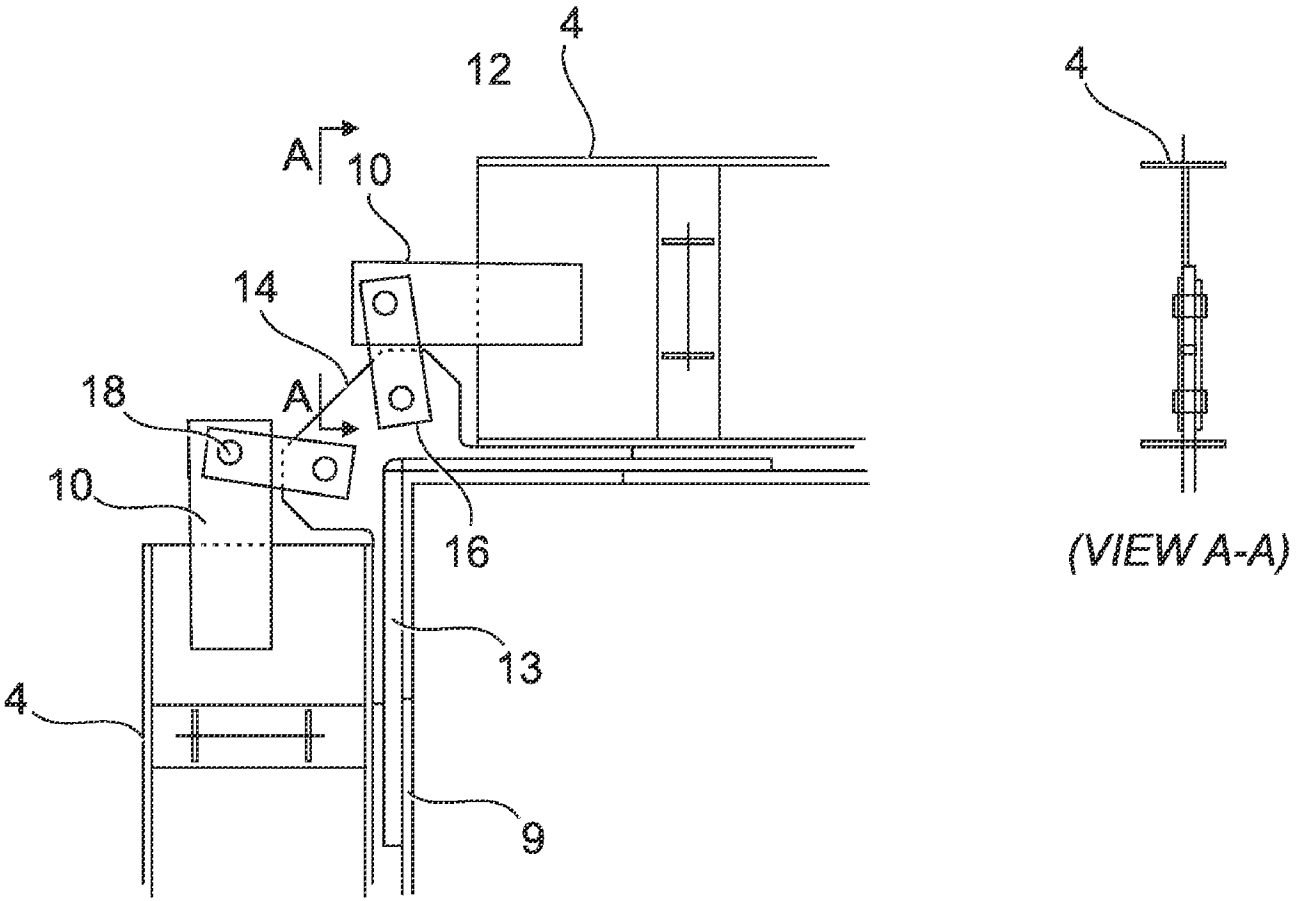
Fig. 2 (PRIOR ART)
FIG. 2 is a more detailed section through the buckstay corner bracket arrangement of FIG. 1.

An arrangement of horizontal buckstays at a restraint level in a typical prior art buckstay system is shown in FIG. 1, with a corner assembly shown in greater detail in FIG. 2.

Boiler walls 5 of a rectangular boiler are surrounded by an arrangement of horizontal buckstays 4 and vertical buckstays 6. Buckstays are of any suitable known construction, for example comprising steel I beams. The arrangement in FIG. 1 is illustrated at a restraint level, and restraints are provided to transmit load to a support framework 1.

As can be seen in particular detail in FIG. 2, a complex arrangement of brackets and links is required to accommodate horizontal expansion as the thermal regime changes. Each horizontal buckstay 4 comprises a single monolithic elongate structural member. Each buckstay 4 is provided with an end bracket 10 which is typically welded to the web portion 12 of the I beam comprising the buckstay. Elongate tie bars 9 are provided. A corner tie 13 and corner bracket 14 are welded to a pair of adjacent tie bars 9 at a corner. A link is provided between the corner bracket 14 which is a fixed part of the tie bar system and the end bracket 10 fixed to each adjacent buckstay 4 by means of the elongate link plates 16 and pin connections 18. The assembly is necessarily complex as it is required thereby to accommodate relative lateral movement of the respective buckstays and tiebar assembly as the conditions change between cold and hot operation.

Figure 3:
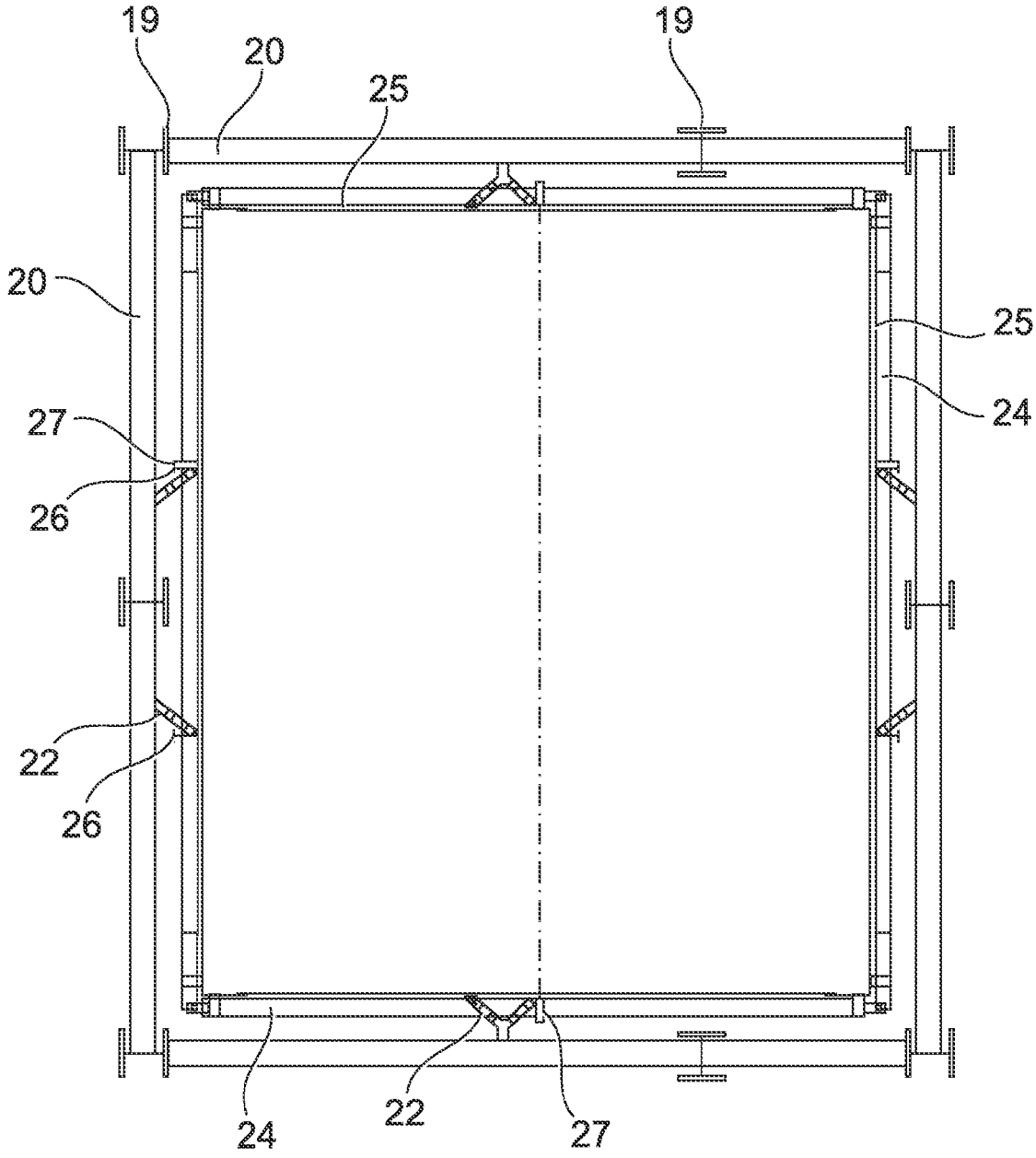
FIG. 3 is a plan section of a horizontal buckstay assembly according to an embodiment of the invention at a restraint level.

FIG. 3 illustrates a typical plan view at a restraint level of an arrangement in accordance with an example embodiment of the invention. This shows a steel support framework comprising horizontal 20 and vertical 19 steel girders which surrounds a boiler wall 25. Horizontal buckstays 24 surround the wall sections and provide a means of reacting to an expansion load within the boiler.

Where the arrangement differs in accordance with the invention is that a buckstay 24 does not comprise a single monolithic whole, but is instead comprised of multiple (in the example two) rigid elongate elements which are relatively slideable at a split point 27. The result of this split is that length changes in a horizontal direction can be accommodated inherently in the horizontal buckstay 24 itself, as the sliding action varies its overall length, which can simplify corner structures as these no longer need to accommodate this.

Vertical buckstays 26 are provided in generally familiar manner. At least one, and depending on the size of the boiler more than one, vertical buckstay may be provided. Preferably, a vertical buckstay is linked to a horizontal buckstay in the vicinity of a split point 27. For example, one of the two vertical buckstays on each long side of the illustrated in FIG. 3, and the single vertical buckstay on each short side in FIG. 3, are so located. Restraints 22 tie the buckstay assembly, again conveniently at these points, to the steel girders which make up the support framework.

Figure 5:
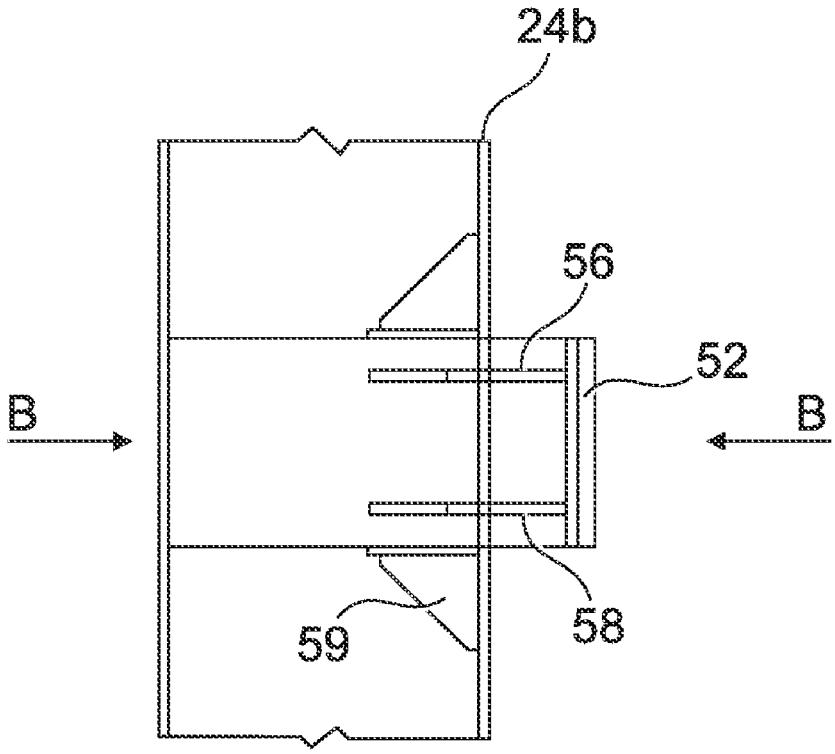
FIG. 5 is a more detailed section through the buckstay anchor assembly of FIG. 4.
Figure 6:
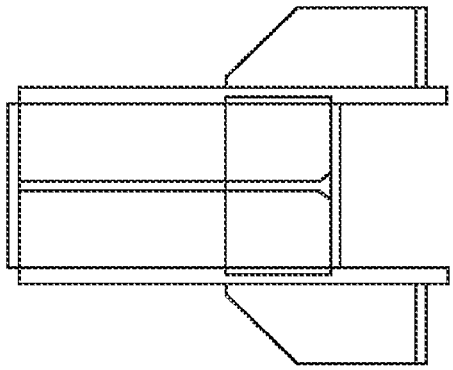
FIG. 6 is a section through B-B of FIG. 5.

This arrangement produces a simplification of the corner structure, which is illustrated in greater detail in FIGS. 4 to 6.

FIG. 4 illustrates a corner portion of a buckstay assembly in accordance with the invention. A pair of horizontal buckstays 24*a*, 24*b* meet at a wall corner.

The direct connection between the two adjacent buckstays meeting at the corner is much simplified. A first horizontal buckstay 24*a* is provided with an elongate buckstay bracket member 30. This engages with a flange surface of a second buckstay 24*b* by means of a cut away of the flange 32 in the vicinity of this bracket. A simple single pin connection 34 in the illustrated embodiment, or any other suitable simple fixed or rotating connection, is all that is needed to tie the two buckstays together at the corner.

A tie bar assembly at the corner comprises the end portions of each respective elongate main tie bar 42 or 46 to which is welded a respective stub tie bar 43 or 47, the assembly being completed by a welded corner reinforcement angle formation 50 that completes the corner, and connects the two tie bars. Buckstays are located on and engage with the tie bar assembly via respective anchors 44 or 48 no more than 600 mm (measure by anchor centre line) inboard of the corner. Buckstay clips 49 engage with the tie bars.

The anchoring arrangement of a first anchor 44 is additionally illustrated with reference to a side elevation representing a view along A-A of FIG. 4*a* as illustrated in FIG. 4*b*. FIG. 4*c* illustrates the use of a cheek plate 40. This anchor formation is illustrated in greater detail in transverse sectional view FIG. 5 (with bearing plates omitted for clarity) and in section through B-B in FIG. 6.

Engagement between the buckstay 24*b* and the tie bar assembly illustrated in FIG. 4 is achieved by the anchoring means 44, and in particular by engagement of a bearing surface 52 on the anchoring means and a bearing pad 54 at an adjacent engagement end of the stub tie bar 43.

A horizontal buckstay 24*b* is brought into a load transferring engagement with the tie bar assembly by means of a pair of anchor plates 56 to be received in an anchor housing 53 in a pair of recesses 55 located above and below the horizontal buckstay. The anchor plate comprises a plate having a 20 mm thickness, 250 mm wide. It is provided with secondary vertical 58 and horizontal 59 stiffening plates which are 10 mm in thickness. It is fixedly mounted, for example by welding, into a corresponding recess 55 so as to be in fixed relationship with the buckstay 24*b*. A forward facing bearing surface 52 then makes a bearing engagement with corresponding bearing surfaces 54 on an adjacent tie bar. Thus, loads may be transmitted to the buckstay system allowing the buckstay system to react against them.

Figure 7:
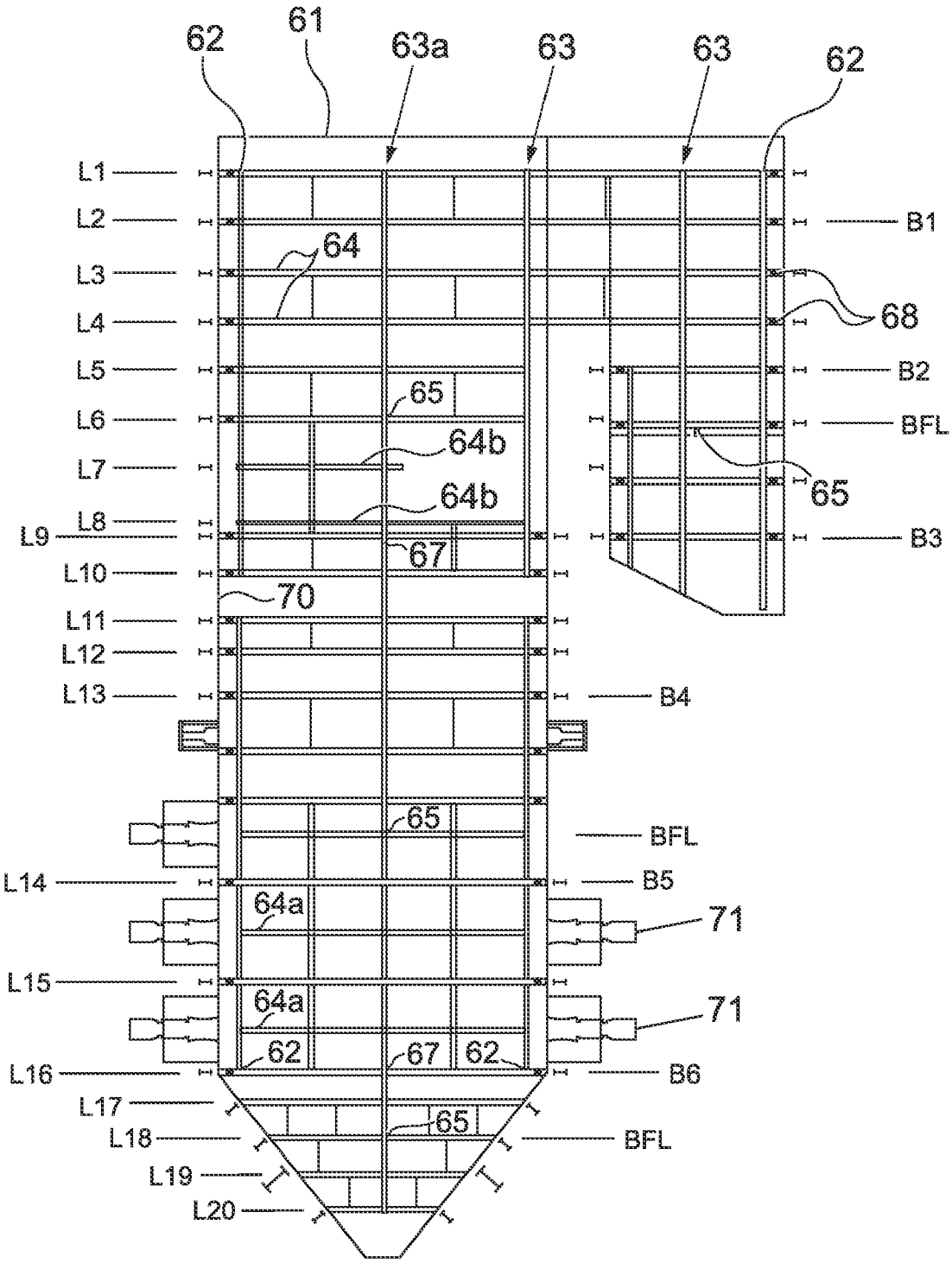
FIG. 7 is a side elevation of a boiler with a buckstay system suitable to embody the principles of the invention.

FIG. 7 illustrates an elevation of a buckstay system used in association with a boiler 61. The buckstay system is designed to transmit transient pressure loading to the boiler support structure via a suitable restraint link system in generally familiar manner, for example as illustrated in FIG. 3.

To that end, the buckstay system generally comprises a framework of horizontal and vertical elongate structures. Horizontal buckstays are provided at a plurality of buckstay levels as illustrated and labelled respectively L1 to L20*a* on the left hand side of FIG. 7. Vertical members comprising continuous O/T posts towards the corners of the boiler structure, and vertical buckstays therebetween, tie with the horizontal buckstays to complete the buckstay assembly.

These vertical buckstays are used in accordance with the invention to split horizontal buckstays which would otherwise extend in continuous manner between boiler corners. The number of vertical buckstays to be used is dependent on many factors including boiler width, depth, sootblowers etc. As a general guide, a single vertical buckstay might be appropriate for a wall width of less than 17 m, two for a wall width of up to 24 m, and three for a wall width of an excessive 24 m. Typically, the vertical buckstays will be positioned such so that they split horizontal buckstays into equal lengths.

Usually vertical buckstays will span from the first buckstay level L1 to the transition header level 70. Buckstays are anchored to wall via a tie bar and anchor arrangement such as described above. Tie bars may be anchored to the boiler wall in such manner as to allow the tie bar to be free to move vertically with the buckstay to provide a vertical buckstay sliding joint 67, or may be anchored to the tube wall to allow no such vertical movement to provide for a buckstay fixed level joint 65 at a buckstay fixed level 66.

Buckstays are linked to the supporting steelwork at the bracing levels only, labelled on the right side of the figure respectively B1 to B6. Where possible, the distance between the horizontal bracing levels above the boiler knuckle is to be no greater than 12 m. The top horizontal bracing level B1 is in line with buckstay level L2.

Each vertical buckstay may be anchored vertically by the horizontal buckstay closest to the mid span of the vertical buckstay. A typically maximum length of the vertical buckstay is likely to be limited by the differential expansion between the wall and the horizontal buckstay closest to the end. In the illustrated embodiment this differential expansion should not exceed 100 mm.

In the illustrated embodiment tie bars are anchored at each horizontal restraint level only.

Most of the horizontal buckstays create a support structure that extends around the perimeter of the boiler, and in particular that is required to extend around the points where two faces of the boiler connect to form a corner, for example in the manner illustrated in FIG. 3. However, other buckstay structures can be noted in FIG. 7, including mini buckstays 64*a* on the burner centre line 71 and mini buckstays 64*b* local to the arch, as will be familiar.

A further possible advantage of the design is that the number of buckstay fixed levels BFL required can be reduced relative to conventional buckstay arrays. In the illustrated embodiment, only three such fixed levels are necessary.

What is claimed is:

1. A buckstay system for a wall of a steam generator having a first wall section which meets a second wall section at an angle to form a corner, the system comprising:

a plurality of horizontal buckstay assemblies each comprising a horizontal buckstay extending generally horizontally across each wall section such as to form a connected pair with an adjacent horizontal buckstay at the said corner, an elongate tie bar formation extending across each wall section such as to form a fixedly mounted pair with an adjacent tie bar formation at the said corner, and an anchor assembly associated with each horizontal buckstay and providing engagement means by which each horizontal buckstay engages with a respective tie bar; and the system further comprising a plurality of vertical buckstays connected to support and space said horizontal buckstay assemblies vertically up the steam generator; wherein each said horizontal buckstay is split to comprise at least two rigid elongate horizontal buckstay elements mounted together to be relatively slidable in a buckstay longitudinal direction;

vertical buckstays are provided in the vicinity of some or all of the points where horizontal buckstay elements of a horizontal buckstay are slidingly engaged; and at a sliding engagement point between two horizontal buckstay elements a vertical support is provided having a fixed engagement with one said horizontal buckstay element, and having a sliding engagement with the other said horizontal buckstay element whereby the other said horizontal buckstay element may slide horizontally relative to the vertical support and relative to the one said horizontal buckstay element.

2. A buckstay system in accordance with claim 1 wherein the connected pair of horizontal buckstays is connected at the said corner by a mechanical connection that does not provide for any expansion in a longitudinal direction.

3. A buckstay system in accordance with claim 1 wherein the connected pair of horizontal buckstays is connected at the said corner by fixed mechanical engagement between a bracket portion on an end of a first such buckstay and a receiving portion on an end of a second such buckstay.

4. A buckstay system in accordance with claim 1 wherein each anchor assembly comprises a support formation fixedly engaged with a horizontal buckstay element, and a bearing surface located to bear upon and engage in use with a surface of a tie bar.

5. A buckstay system in accordance with claim 4 wherein the support formation is a support plate.

6. A buckstay system in accordance with claim 5 wherein two rectangular support plates, comprising an upper and a lower support plate, are deployed above and below a horizontal buckstay element.

7. A buckstay system in accordance with claim 6 wherein the support plates comprise additional stiffening plates in a direction parallel to and/or perpendicular to a longitudinal direction of the horizontal buckstay.

8. A buckstay system in accordance with claim 1 wherein each anchor assembly is provided on a horizontal buckstay element no more than 600 mm inboard of a corner formed by its associated wall and the adjacent wall.

9. A buckstay system in accordance with claim 1 wherein the adjacent tie bars are fixedly mounted to each other at the corner by means of an end connection corner angle reinforcement tie welded to the pair of tie bars.

10. A buckstay system in accordance with claim 1 wherein each horizontal buckstay element comprises a rigid elongate structural member having a web shaped surface.

11. A buckstay system in accordance with claim 10 wherein a sliding engagement connection is provided between a pair of horizontal buckstay elements which permits sliding movement in a longitudinal direction of the two horizontal buckstay elements by means of relative sliding of the web surfaces.

12. A buckstay system for a wall of a steam generator having plural wall sections which meet adjacent wall sections at an angle comprising:

a plurality of horizontal buckstay assemblies each comprising a horizontal buckstay extending generally horizontally across each wall section such as to form a connected pair with an adjacent horizontal buckstay at each said corner, an elongate tie bar formation extending across each wall section such as to form a fixedly mounted pair with an adjacent tie bar formation at each said corner, and an anchor assembly associated with each horizontal buckstay and providing engagement means by which each horizontal buckstay engages with a respective tie bar; and the system further comprising a plurality of vertical buckstays connected to support and space said horizontal buckstay assemblies vertically up the steam generator; wherein each said horizontal buckstay is split to comprise at least two rigid elongate horizontal buckstay elements mounted together to be relatively slidable in a buckstay longitudinal direction;

vertical buckstays are provided in the vicinity of some or all of the points where horizontal buckstay elements of a horizontal buckstay are slidingly engaged; and at a sliding engagement point between two horizontal buckstay elements a vertical support is provided having a fixed engagement with one said horizontal buckstay element, and having a sliding engagement with the other said horizontal buckstay element whereby the other said horizontal buckstay element may slide horizontally relative to the vertical support and relative to the one said horizontal buckstay element.

13. A buckstay system in accordance with claim 12 wherein each anchor assembly comprises a support formation fixedly engaged with a horizontal buckstay element, and a bearing surface located to bear upon and engage in use with a surface of a tie bar.

14. A buckstay system in accordance with claim 13 wherein the support formation is a support plate.

15. A buckstay system in accordance with claim 14 wherein two rectangular support plates, comprising an upper and a lower support plate, are deployed above and below a horizontal buckstay element.

16. A buckstay system in accordance with claim 15 wherein the support plates comprise additional stiffening plates in a direction parallel to and/or perpendicular to a longitudinal direction of the horizontal buckstay.

17. A buckstay system in accordance with claim 12 wherein each anchor assembly is provided on a horizontal buckstay element no more than 2 m inboard of a corner formed by its associated wall and the adjacent wall.

18. A buckstay system in accordance with claim 17 wherein each anchor assembly is within 600 mm of such a corner.

19. A buckstay system in accordance with claim 12 wherein the adjacent tie bars are fixedly mounted to each other at the corner by means of an end connection corner angle reinforcement tie welded to the pair of tie bars.

20. A buckstay system in accordance with claim 12 wherein each horizontal buckstay element comprises a rigid elongate structural member having a web shaped surface.

21. A buckstay system in accordance with claim 20 wherein a sliding engagement connection is provided between a pair of horizontal buckstay elements which permits sliding movement in a longitudinal direction of the two horizontal buckstay elements by means of relative sliding of the web surfaces.

* * * * *

UNITED STATES PATENT AND TRADEMARK OFFICE

CERTIFICATE OF CORRECTION

PATENT NO. : 8,333,170 B2
APPLICATION NO. : 12/342658
DATED : December 18, 2012
INVENTOR(S) : Dewan Shamsuz Zaman It is certified that error appears in the above-identified patent and that said Letters Patent is hereby corrected as shown below:

On the Title Page, Item (73)

The correct spelling of the Assignee is: Doosan Babcock Energy America.

Signed and Sealed this
Seventh Day of May, 2013

Teresa Stanek Rea

Teresa Stanek Rea
*Acting Director of the United States Patent and Trademark Office*